US005939146A

United States Patent [19]

Lavernia

[11] Patent Number: 5,939,146

[45] Date of Patent: Aug. 17, 1999

[54] METHOD FOR THERMAL SPRAYING OF NANOCRYSTALLINE COATINGS AND MATERIALS FOR THE SAME

[75] Inventor: Enrique J. Lavernia, Santa Ana, Calif.

[73] Assignee: The Regents of the University of California, Oakland, Calif.

[21] Appl. No.: 08/988,881

[22] Filed: Dec. 11, 1997

Related U.S. Application Data

[60] Provisional application No. 60/033,317, Dec. 11, 1996.

[51] Int. Cl.[6] ..... C23C 4/04

[52] U.S. Cl. ..... 427/446; 29/DIG. 39

[58] Field of Search ..... 427/446; 264/9; 29/DIG. 39

[56] References Cited

U.S. PATENT DOCUMENTS

| | | | |
|---|---|---|---|
| 3,617,358 | 11/1971 | Dittrich | 264/12 |
| 4,746,468 | 5/1988 | Ozaki et al. | 264/9 |
| 5,395,422 | 3/1995 | Schulz et al. | 75/255 |

*Primary Examiner*—Katherine A. Bareford
*Attorney, Agent, or Firm*—Daniel L. Dawes

[57] ABSTRACT

Nanocrystalline coating are prepared using a two step approach. First, the grain size of: micrometer sized powders is reduced to nanometer dimensions using high energy ball milling. This is undertaken using attritor mills. Second, the nanocrystalline powders are dried and introduced into the high velocity oxygen fuel (HVOF) process and produce a coating with refined microstructure. The finished coating can be several mm in thickness. In addition a three dimensional device can be spray formed.

14 Claims, 1 Drawing Sheet

METHOD FOR THERMAL SPRAYING OF NANOCRYSTALLINE COATINGS AND MATERIALS FOR THE SAME

RELATED APPLICATIONS

The present application relates to provisional application 60/033,317 filed Dec. 11, 1996, which is incorporated herein by reference.

This invention was made with support under Grant Numbers N00014-94-1-0017 and N00014-93-1-1072 from the Department of the Navy. Accordingly, the U.S. Government may have certain rights in the invention.

BACKGROUND OF THE INVENTION

1. Field of the Invention

The invention relates to the field of thermal spraying of coatings onto objects and in particular the thermal spraying of nanocrystalline materials.

2. Description of the Prior Art

Significant interest has been generated recently in the field of nanoscale (nanocrystalline, nanophase ) materials. This arises from the outstanding properties that can be obtained in such materials. Also there is a realization that early skepticism about the ability to produce high quality, unagglomerated nanoscale powder was unfounded.

The present focus is shifting from synthesis to processing, i.e., to the manufacture of useful coatings and structures from these powders. The potential applications span the whole spectrum of technology, from thermal barrier coatings for turbine blades to wear resistant rotating parts. The potential economic impact is several billions of dollars per year.

Significant progress has been made in various aspects of processing on nanoscale materials. Most of this work has been focused on the fabrication of bulk structures See E. Y. Gutmanas, L. I. Trusov, and I. Gotman, *NanoStructured Matls.,* 8 (1994) 893–901; G. E. Fougere, L. Riester, M. Ferber, J. R. Weertman, and R. W. Siegel, *Mat. Sci. Eng.,* A204 (1995) 1–6; and G. E. Korth and R. L. Williamson, *Metallurgical and Materials Transactions A,* 26A (1995) 2571–1578.

A great deal of effort has gone into enhancing our understanding of the synthesis and structural characteristics of nanocrystals. More recently, greater scientific emphasis is being placed on the physical and mechanical characteristics of nanocrystalline ceramics and metals, since it is evident that it is possible to achieve combinations of properties that are otherwise unachievable with equilibrium materials.

For example, it is possible to sinter nanophase ceramics at temperatures that are substantially lower than those required by coarse grained ceramics, due to their fine microstructures, small diffusion scales, and high grain boundary purity. Nanophase ceramics are reported to exhibit unusually high ductility, whereas nanophase metals are noted to exhibit ultra-high hardness values.

In addition, recent work suggests improvements in other physical properties. For example, it has been shown that the thermal expansion coefficient of a nanocrystalline Ni-P alloy ($21.6\times10^{-6}K^{-1}$) is 56% higher than that of the coarse grained material of equivalent composition. It has been suggested that since the specific heat of a material is intimately related its vibrational and configurational entropy, the observed behavior may be attributable to the complicated structure associated with the grain boundaries of the nanocrystalline material.

In related work it was demonstrated that it was possible to obtain a high saturation flux density, a low magnetostriction, and excellent soft magnetic characteristics in nanocrystalline Fe-B-M materials where M=Cu, Nb, Mo, W, Ta.

What is perhaps most unusual about nanocrystalline materials is the fact that, despite being classified as nonequilibrium materials, recent work shows that their grain size may, in some cases, remain metastable during exposure to elevated temperatures. Although this phenomenon is not clearly understood, it has been suggested that the unusual resistance of the nanocrystals to coarsening may be due to their narrow size distribution.

A wide range of preparation methods have been developed for the fabrication of nanocrystalline materials. See, C. Suryanarayana, *International Materials Reviews,* 40 (1995) 41–64. However, these are largely regarded as a two step processes in which nanocrystalline material is first synthesized in powder form and subsequently consolidated into bulk form.

BRIEF SUMMARY OF THE INVENTION

The present invention concerns the combination of forming nanocrystalline materials and then thermal spraying these materials to form a coating or a device. A body has a three dimensional characteristic in the sense that it is greater than a conventional coating on a substrate.

The present invention applies a two step approach. The first step, powder synthesis, is achieved using mechanical alloying techniques. This selection is based upon the capability of the process to economically produce significant quantities of nanocrystalline powders for a variety of alloy systems. See, C. C. Koch, *NanoStructured Matls.,* 2 (1993) 109–129. The second step, consolidation, is performed using a thermal spray process.

This process is a viable means of applying coatings onto metal substrates from precursor powders.

Thermal spraying of nanocrystalline materials represents a significant approach to exploit the unusual physical attributes of nanocrystalline materials. Nanophase ceramics, for example, are reported to exhibit unusually high ductility, whereas nanophase metals are noted to exhibit ultra-high hardness values.

In particular, the spraying of thermally stabilized powder, for example as achievable by cryomilling, has been shown to yield coatings with hardness values that are approximately 63% higher than those of conventionally sprayed materials.

The properties of the thermally sprayed coatings may be compared to hose of samples consolidated using conventional hot pressing techniques.

The invented process uses deposition of coatings by thermally activated rocesses. This includes so called "thermal spray" such as High Velocity Oxy-Fuel (HVOF) and plasma spray, but also includes new innovations such as chemical vapor condensation (CVC) and a number of new combustion processes. For example, a modified HVOF process has been used to fabricate dense coatings of Co/WC with remarkable properties. Moreover, the HVOF process, motivated by the problem of depositing nanoscale materials, promises to revolutionize the thermal spray industry as a whole.

Heretofore, only coarse grained powders, such as typically in the range of 20–100$\mu$ in diameter, were used in thermal spraying processes. Powder of substantially smaller size would tend to largely blown out of the spray to the peripheries with the result that the particles would not be heated or well deposited. Furthermore, the use of nanocrystalline material was contraindicated, because it was widely understood that subjecting nanocrystalline material to the temperatures which are needed in thermal spraying would simply cause the grain boundaries of the nanocrystalline material to grow so that it was no longer nanocrystalline. In any case, it was obvious that material which was nanometer in size was far too small to be effectively used in any thermal spray process. What the invention has surprisingly shown is that as small chip or coarse grain material is milled to nanocrystalline size and as the milling process is further controlled so that mechanical welding and alloying of the nanocrystalline material occurs, agglomerated nanocrystalline material of different physical morphologies can be formed. The agglomerated nanocrystalline material has a size or dimensions in the range of coarse grained material, typically in the range of 20–100$\mu$, but retains the advantageous crystallographic properties of nanocrystalline material. The result is that the agglomerated nanocrystalline material can be practically used in thermal spray processes contrary to what was earlier believed. Even more surprising is the fact that the grain boundaries of the agglomerated nanocrystalline material appeared to be pinned in some manner and do not grow under the temperatures and times to which such agglomerated nanocrystalline material are subjected in thermal spray processes. The result is that thermally sprayed coatings of high quality nanocrystalline material are achieved with the retention of all the material properties and benefits of nanocrystalline material.

These processes and the invention are described in greater detail below and illustrated in the context of the following figures wherein like elements are referenced by like numerals.

DETAILED DESCRIPTION OF THE PREFERRED EMBODIMENTS

The invention integrates the procedure of the formation of nanocrystalline materials and the thermal spraying these materials to form a coating or a device. Powder synthesis is achieved using mechanical alloying techniques and variations thereof, such as cyromilling. Although cyromilling is one technique for achieving mechanical alloying, it has been demonstrated that milling in noncryogenic agents also produces acceptable mechanical alloying. Hence, any method now known or later discovered for producing mechanical alloying is expressly contemplated as being within the scope of the invention.

Figure 2:
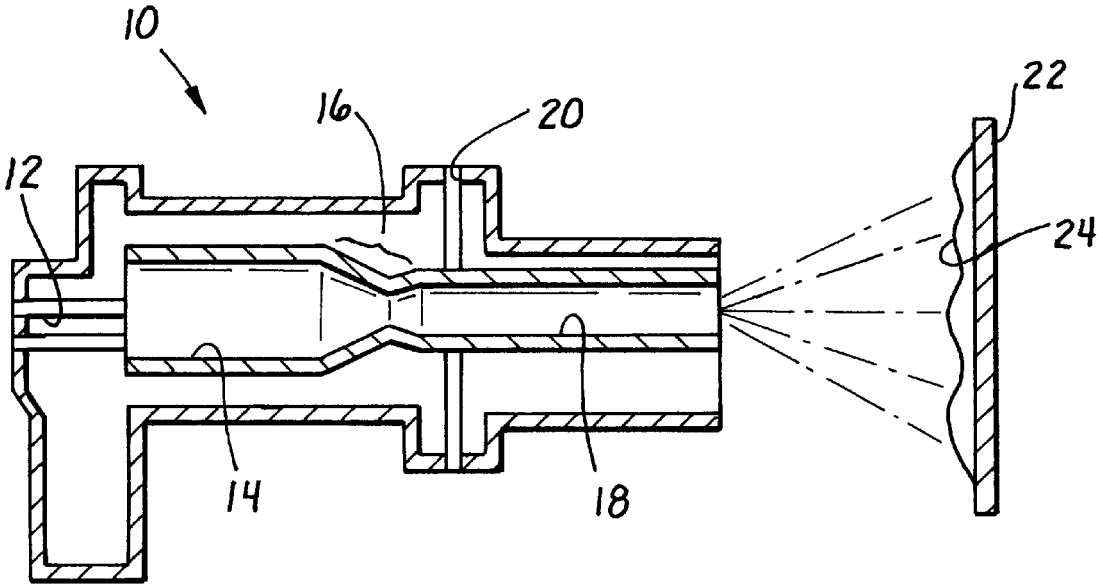
FIG. 2 is a diagrammatic side cross-sectional view of an HVOF spraying device applied to a nanocrystalline powders according to the invention.

Thereafter consolidation of the powder is performed using a thermal spray process. This combination is achieved through the system illustrated in FIG. 2. In FIG. 2 the procedure is as follows. Oxygen and a fuel, such as propylene or hydrogen, with a defined ratio are introduced through input port 12 and ignited in a combustion chamber 14 of an HVOF gun 10. The gas mixture of oxygen and the fuel travels through a convergent-divergent nozzle section 16 and accelerates toward barrel 18. Nanocrystalline powders are injected through input port 20 perpendicularly into barrel 18 and subsequently heated by the reactive gas, namely the burning oxygen/fuel mixture. The hot powders accelerate towards substrate 22 to form a nanocrystalline coating 24. Ideally the hot powders are neither molten nor semi-molten. Although some particles in the powder could be molten or semi-molten, this is neither necessary nor preferred.

Mechanical Alloying

Mechanical alloying is a process by which the microstructure of elemental or pre-alloyed powder particles is modified by repeated mechanical welding and fracture events. This has been observed to result in metastable microstructures including nanocrystalline grain sizes, supersaturated solid solutions and amorphization. See, P. S. Gilman and J. S. Benjamin, *Ann. Rev. Mater. Sci,* 13 (1983) 279–300; and C. C. Koch, *Annual Review Materials Science,* 19 (1989) 121–143. The process is performed using an apparatus 30 as shown in FIG. 1 in which milling balls 26 are continuously agitated by external vibration (shaker-type mills) or as shown in FIG. 1 a rotating impeller 28 (attritor mills).

Figure 1:
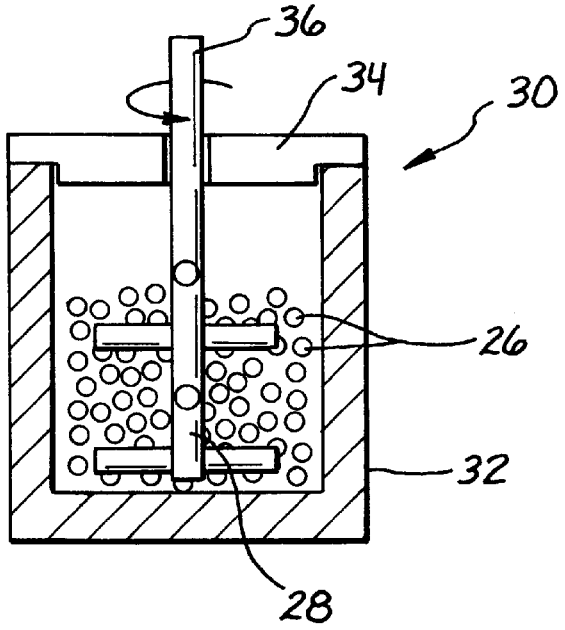
FIG. 1 is a diagrammatic side cross-sectional view of a typical attritor ball mill in which the mechanical alloying step of the invention is practiced.

The components of an attritor-type ball mill 30, representative of the type to be used in this project, are shown in FIG. 1 and include a container 32 with a cover 34 in which rotating impeller 28 is contained. Impeller 28 is rotated on a shaft 36 by a motor (not shown). Experimental variables affecting the final powder characteristics include shaft speed, ball size and the ball-to-powder mass ratio. The attritor milling process has been the subject of systematic modeling efforts, which have provided a theoretical foundation for selection of optimal milling parameters. See, R. W. Rydin, D. Maurice, and T. H. Courtney, *Metall. Trans. A* 24A (1993) 175–185; T. M. Cook and T. H. Courtney, *Metallurgical and Materials Transactions A,* 26A (1995) 2389–2397; D. Maurice and T. H. Courtney, *Metallurgical and Materials Transactions A,* 26A (1995) 2431–2435; D. Maurice and T. H. Courtney, *Metallurgical and Materials Transactions A,* 26A (1995) 2437–2444; Maurice and Courtney, *Metall. Trans. A,* 25A (1994) 147–158.

As discussed above small chip or coarse grain material is milled to nanocrystalline size and the milling process is further controlled so that as mechanical welding and alloying of the nanocrystalline material occurs, agglomerated nanocrystalline material of different physical morphologies are formed. The agglomerated nanocrystalline material has a size or dimensions in the range of materials conventionally used in thermal spray processes or coarse grained material, typically in the range of 20–100$\mu$. The milling process is controlled by varying the parameters of time duration of milling, temperature of milling, milling media, ball-to-powder mass ratios, speed of milling, impeller design, mill design and any other factor, which enters into the specific milling technique employed, and combinations of the same. For example, depending on the time duration of milling, generally round coarse grain starting material is taken down to nanocrystalline size. As milling continues the nanocrystalline sized particles mechanically weld and agglomerate into either flattened flakes of agglomerated nanocrystalline material or into more three dimensional stone shaped agglomerated nanocrystalline material depending on whether the extended milling time is shorter or longer respectively. The grain morphology of the resulting agglomerated nanocrystalline material can also be controlled through selection of the milling media. The use of cryogenic media tends to produce spherical agglomerates whereas room temperature organic media such as methanol tend to produce flat agglomerates.

An additional advantage of the invention is that the starting material which will be manufactured into agglomerates of nanocrystalline material and thermally sprayed into a coating need not be in powder form. The cost of powder form material can be high and to render their use in thermal spray processes diseconomic. Using the milling approach of the invention allows the use of starting materials in non-powder form, such as ground particulates or chips, which can be produced much more cheaply in many cases.

Addition of Cryogenic Liquid

The addition of cryogenic liquid media to the milling environment greatly affects the attritor milling process. The cryogenic ball milling, or "cryomilling" process was developed by Luton et al. in order to enable the effective milling of ductile Al powders. See, M. J. Luton, C. S. Jayanth, M. M. Disko, S. Matras, and J. Vallone, in L. E. McCandlish, et al., (eds), *Multicomponent Ultrafine Microstructures,* Materials Research Society Symposium Proceedings, Pittsburgh, Pa., 1989, pp. 79–86. This work also demonstrated that cryomilling in liquid nitrogen leads to the in situ formation of nanometer scale oxy-nitrides. See M. J. Luton, C. S. Jayanth, M. M. Disko, S. Matras, and J. Vallone, in L. E. McCandlish, et al., (eds), *Multicomponent Ultrafine Microstructures,* Materials Research Society Symposium Proceedings, Pittsburgh, Pa., 1989, pp. 79–86; and M. M. Disko, M. J. Luton, and H. Shuman, *Ultramicroscopy,* 37 (1991) 202–209. Observations of significant thermal stability in the cryomilled powders were attributed to the pinning effect of these oxy-nitride particles. Subsequent work has shown that the cryomilling process may provide grain size stabilization in other alloy compositions such as Ni-Al (See, B. L. Huang, Ph.D. Dissertation, Rutgers University, New Brunswick, N.J. (1994); B. Huang, J. Vallone, and M. J. Luton, *NanoStructured Matls.,* 5 (1995) 411–424) and Fe-Al (See, R. J. Perez, B. Huang, and E. J. Lavernia, *NanoStructured Matls.,* (1996) in press). The stabilizing effect is applied to retain a nanocrystalline microstructure during the subsequent thermal spray process.

Thermal Spray

Thermal spray is a technique by which molten, or semi-molten particles are deposited onto a substrate, and the microstructure of the coating results from the solidification/bonding of the particulates. See, L. Pawlowski, *The Science and Engineering of Thermal Spray Coatings.* John Wiley & Sons, England, 1995. Thermal spray combines particle melting, quenching and consolidation in a single operation. This attractive technology, facilitated by an achievement of metallurgical and chemical homogeneity, is used for fabrication of a variety of simple preform shapes.

Thermal spray was originally developed for corrosion resistant zinc coatings as well as coatings for other refractory metals. See, L. Pawlowski, *The Science and Engineering of Thermal Spray Coatings.* John Wiley & Sons, England, 1995; T. S. Srivatsan and E. J. Lavernia, *J. Mater. Sci.,* 27 (1992) 5965. Today, thermal spraying technology has been applied to many coating applications including:

1. Arc plasma spray (APS) coating of $Cr_2O_3$ on hardened steel drilling components in petroleum mining to improve the service lifetime. See, L. Pawlowski, *The Science and Engineering of Thermal Spray Coatings.* John Wiley & Sons, England, 1995;

2. High velocity oxy-fuel (HVOF) coating of stainless steel 316L to provide protection against sulfur and ammonia corrosion in chemical refinery vessels. See, L. Pawlowski, *The Science and Engineerng of Thermal Spray Coatings.* John Wiley & Sons, England, 1995; L. N. Moskowitz, in C. C. Berndt, (ed) *Thermal Spray: International Advances in Coatings Technology,* ASM International, Materials Park, Ohio, 1992, pp. 611;

3. WC-cermet coating produced by HVOF onto the contact surface of steel rolls to increase their abrasion and friction resistance in steel rolling applications. See, Y. Matsubara and A. Tomiguchi, *Thermal Spray: International Advances in Coatings Technology,* ASM International, Materials Park, Ohio, 1992, pp. 637;

4. $Al_2O_3$ coating by APS on aluminum midplate for diode assembly in automotive alternators to provide resistance against salt corrosion and moisture absorption. See, L. Pawlowski, *The Science and Engineering of Thermal Spray Coatings.* John Wiley & Sons, England, 1995; L. Byrnes and M. Kramer, in C. C. Berndt and S. Sampath, (eds), 1994 *Thermal Spray Industrial Applications,* ASM International, Materials Park, Ohio, 1994, pp. 39;

5. Thermal barrier coatings (TBCs) of $ZrO_2$-$Y_2O_3$ (outer layer)/CoCrAlY (bond layer) by plasma spray to reduce heat transfer and thus increase engine efficiency in an adiabatic diesel engine. See, L. Pawlowski, *The Science and Engineering of Thermal Spray Coatings.* John Wiley & Sons, England, 1995; H. Chen, Z. Liu, Y. Zhuang, and L. Xu, *Chinese Journal of Mechanical Engineering,* 5 (1992) 183

6. Wear resistant coatings of WC-M where M=Ni, Co, or Co-Cr by HVOF or APS on the compressor fan and disc mid-span stiffeners in aeroengines. See, A. R. Nicoll, A. Bachmann, J. R. Moens, and G. Loewe, in C. C. Berndt, (ed) *Thermal Spray: International Advances in Coatings Technology,* ASM International, Materials Park, Ohio, 1992, pp. 149; K. Niemi, P. Vuoristo, T. Mantyla, G. Barbezat, and A. R. Nicoll, in C. C. Berndt, (ed) *Thermal Spray: International Advances in Coatings Technology,* ASM International, Materials Park, Ohio, 1992, pp. 685.

Thermal sprayed coatings are also widely used in electronic industries (C. W. Smith, in B. N. Chapman and J. C. Anderson, (eds), *Science and Technology of Surface Coatings,* Academic Press, London, 1974, pp. 262), powder generation plants (P. R. Taylor and M. Manrique, *JOM,* 48 (1996) 43), marine gas-turbine engines (H. Schmidt and D. Matthaus, *9th International Thermal Spray Conference,* Netherlands Institute voor Lastechniek, The Hague, Netherlands, 1980, pp. 225), ceramic industries and printing industries.

In principle, powder, rods, and wires can be used as precursor materials in the thermal spray process. Metals and alloys in the form of rods or wires are commonly used in arc spraying (AS) and flame spraying (FS). See, L. Pawlowski, *The Science and Engineering of Thermal Spray Coatings.* John Wiley & Sons, England, 1995. Powders of metals, alloys, ceramic oxides, cermets, and carbides are often used in thermal spraying to produce a homogeneous microstructure in the resulting coating. In most cases, the sprayed surface is degreased, masked and roughened prior to spraying to maximize the bonding strength between the coating and the substrate material. Various techniques for pre-sprayed treatment are also well known and included as equivalent to what is described here. See, H. Schmidt and D. Matthaus, *9th International Thermal Spray Conference,* Netherlands Instituut voor Lastechniek, The Hague, Netherlands, 1980, pp. 225.

Various thermal spraying techniques are applicable. These include flame spraying (FS), atmospheric plasma spraying (APS), arc spraying (AS), detonation gun (D-gun) spraying, high velocity oxy-fuel spraying (HVOF), vacuum plasma spraying (VPS), and controlled atmosphere plasma spraying (CAPS). These techniques are widely used to produce various coatings for industrial applications. Typical process parameters of various thermal spraying techniques mentioned above are listed in Table 1 below. See also L. Pawlowski, *The Science and Engineering of Thermal Spray Coatings.* John Wiley & Sons, England, 1995.

TABLE 1

Process parameters of various thermal spraying techniques

| Thermal Spraying Technique | Working Flame | Flame Temp. (K.) | Flame velocity (m/s) | Powder particle sizes ($\mu$m) | Powder injection feed rate (g/min) | Spraying distance (mm) |
|---|---|---|---|---|---|---|
| FS | fuel + $O_2$ (g) | 3000–3350 | 80–100 | 5–100 | 50–100 | 120–250 |
| APS | Ar, or mixture of AR + $H_2$ , Are + He, Ar + $N_2$ (g) | up to 14,000 | 800 | 5–100 | 50–100 | 60–130 |
| AS | various electrically conductive wire, e.g. An, Al | are temp up to 6100 K. by an arc of current of 280 A[a] | velocity of molten particles formed can reach up to 150 m/s | n/a | 50–300 | 50–170 |
| D-gun spray | detonation wave form a mixture of acetylene + $O_2$ | up to 4500 K. with 45% acetylene | 2930[b] | 5–60 | 16–40[c] | 100[d] |
| HVOF | fuel gases (acetylene, kerosene, propane, propylene or $H_2$) + $O_2$ | up to 3440 K. at ratio of $O_2$ to acetylene (1.5:1 by volume) | 2000 | 5–45 | 20–80 | 15–300 |
| VPS | Ar mixed with $H_2$, He or $N_2$ | expressed in electron temp. of 10,000 to 15,000 K. | velocity of plasma between 1500–3000 | 5–20 | 50–100 (spray in vacuum) | 300–400 |
| CAPS | same as APS | same as APS | same as APS | same as APS | same as APS | 100–130 mm in SP |

[a]. R. C. Tucker, in R. F. Bunshah, (ed) Deposition Technologies for Films and Coatings, Noyes Publications, New Jersey, 1982, pp. 454.
[b]. D. R. Marantz, in B. N. Chapman and J. C. Anderson, (eds), Science and Technology of Surface Coating, Academic Press, London, 1974, pp. 308.
[c]. R. G. Smith, Science and Technology of Surface Coating, Academic Press, London, 1974, pp. 271.
[d]. Y. S. Borisov, E. A. Astachov, and V. S. Klimenko, Detonation Spraying: Equipment, Materials and Applications. Thermische Spritzkonferenz, Essen, Germany, 1990, p.
[e]. E. Schwarz, 9th International Thermal Spray Conference, Netherlands Institut voor Lastechniek, The Hague, 1980, pp. 91.
[f]. K. Niederberger and B. Schiffer, Eigenshaften Varschiedener Gase und Deren Einfluss Beim Thermischen Spritzen. Thermische Spritzkonferenz, Essen, Germany, 1990, p. 1.

Flame spray (FS), sometimes referred as combustion flame spraying, involves the combustion of fuel gas in oxygen (1:1 to 1.1:1 in volume ratio) to heat the feedstock (in the form powders, wires, or rods). See, M. Okada and H. Maruo, *British Welding Journal,* 15 (1968) 371. The flame gases are introduced axially, and the particles travel a direction perpendicular to the flame gases. The particles are thereby heated and accelerated toward the target substrate. The coating thickness produced by FS is typically 100–2500 $\mu$m and porosity ranges from 10 to 20%. The bond strength for FS ceramic coatings is approximately 15 MPa and 30 MPa for other materials. The bond strength of NiAl coating produced by FS can reach up to 60 MPa. See, L. Pawlowski, *The Science and Engineering of Thermal Spray Coatings.* John Wiley & Sons, England, 1995.

In atmospheric plasma spray (APS) the flame gas (Ar or mixture of Ar+$H_2$, Ar+He and +$N_2$) is heated by a plasma generator (60 kW or more) which produces an electric arc. The advantages of plasma processing include; a clean reaction atmosphere, which is needed to produce a high purity material; a high enthalpy, to enhance the reaction kinetics by several orders magnitude; high temperature gradients, providing the possibility of rapid quenching and generation of fine particles size. See, R. T. Smyth, F. J. Dittrich, and J. D. Weir, *International Conference on Advances in Surface Coating Technology,* London, 1978, pp. 233. Due to the high temperature of the flame gases (up to 14,000 K), APS is commonly used to produce ceramic TBCs of $Y_2O_3$-stabilized $ZrO_2$ (H. Chen, Z. Liu, Y. Zhuang, and L. Xu, *Chinese Journal of Mechanical Engineering,* 5 (1992) 183; and. A. P. Bennett and M. B. C. Quigley, *Welding and Metal Fabrication,* (1990) 485), $Al_2O_3$-$ZrO_2$, and other cermet coatings. The bond strength of typical ceramic coating produced APS is in between 15–25 MPa and 70 MPa for some bonding alloys (NiAl, NiCrAl) or metals (Mo). The porosity of APS coatings is generally lower (1–7%) than those produced by FS and thickness of the coating ranges from 50–500 $\mu$m. See, L. Pawlowski, *The Science and Engineering of Thermal Spray Coatings.* John Wiley & Sons, England, 1995.

Arc spraying (AS) involves two electrically conductive wires (Zn or Al) which are arc melted, and the molten particles are propelled by a compressed gas. The high velocity gas (flow rate of 1–80 $m^3$/hr) acts to atomize the melted wires and to accelerate the fine particles to the substrate. Alloy coatings can be produced if the wires are composed of different materials. See, L. Pawlowski, *The Science and Engineering of Thermal Spray Coatings.* John Wiley & Sons, England, 1995. The thickness of the coating produced by AS is between 100–1500 $\mu$m, and the bond strength is in the range of 10–30 MPa for Zn and Al coatings. See, D. J. Wortman, *J. of Vac. Sci. and Tech.,* A3 (1985) 2532.

Detonation-gun (D-gun) spraying is commonly used in producing WC-Co and $Al_2O_3$ coatings due to the low resultant porosity (~0.5% for WC-Co) and high bond strength (83 MPa for WC-Co). See, L. Pawlowski, *The Science and Engineering of Thermal Spray Coatings.* John Wiley & Sons, England, 1995; and T. J. Roseberry and F. W. Boulger, *A Plasma Flame Spray Handbook, U.S. Department of Commerce Report No. MT*-043. National Technical Information Service, Springfield, Va., p. In D-gun spraying, a mixture of flame gas (oxygen and acetylene) is fed to a long barrier with a charge of powder. Upon ignition, a detonation wave is produced (1–15 detonation/s) which delivers the powder particles at a velocity up to 750 m/s to the substrate. See, L. Pawlowski, *The Science and Engineering of Thermal Spray Coatings.* John Wiley & Sons, England, 1995.

High velocity oxy-fuel (HVOF) spraying represents a most significant development in the thermal-spray industry since the development of plasma spray. HVOF is characterized by high particle velocities and relatively low thermal energy when compared to plasma spraying. The applications of HVOF have expanded from the initial use of tungsten carbide coatings to include different coatings that provide resistance to wear or erosion/corrosion. See, D. W. Parker and G. L. Kutner, *Adv. Mater. Process.,* 140 (1991) 68.

HVOF uses an internal combustion jet fuel (propylene, acetylene, propane and hydrogen gases) to generate a hypersonic gas velocity of approximately 2,000 m/s, more than five times the speed of sound. When burned in conjunction with pure oxygen, these fuels can produce a gas temperature greater than 3029 K. See, L. Pawlowski, *The Science and Engineering of Thermal Spray Coatings.* John Wiley & Sons, England, 1995. The powder particles are injected axially into the jet gas. The powders are heated, and propelled toward the substrate. With the relatively low temperature the flame gas associated with the HVOF system, the particles are made highly plastic by convective heat transfer and superheating or vaporization of individual particles are prevented. See, D. J. Varacalle, et al., in C. C. Berndt, (ed) *Thermal Spray: International Advances in Coatings Technology,* ASM International, Materials Park, Ohio, 1992, pp. 181. Furthermore, lower particle temperatures experienced in carbide coatings lead to less carbide depletion than plasma sprayed coatings. In effect, the advantages of HVOF process over conventional plasma spraying are higher coating bond strength, lower oxide content, and improved wear resistance due to a homogeneous distribution of carbides. See, T. S. Srivatsan and E. J. Lavernia, *J. Mater. Sci.,* 27 (1992) 5965; and D. Apelian, D. Wei, and B. Farouk, *Metall. Trans.,* 20B (1989) 251.

Vacuum plasma spraying (VPS), sometimes referred to as low-pressure plasma spraying (LPPS), consists of a plasma jet stream produced by heating an inert gas by an electric arc generator (requiring more power than that for APS). See, L. Pawlowski, *The Science and Engineering of Thermal Spray Coatings.* John Wiley & Sons, England, 1995. The powders are introduced into the plasma jet in vacuum, undergo melting, and accelerate towards the substrate material. See, L. Pawlowski, *The Science and Engineering of Thermal Spray Coatings.* John Wiley & Sons, England, 1995; and T. S. Srivatsan and E. J. Lavernia, *J. Mater. Sci.,* 27 (1992) 5965. The position of the injection port in the nozzle plays an important role in VPS, since the pressure of the powder injector must be greater than the pressure in the nozzle in order to propel the powders properly. See, M. E. Vinayo, L. Gaide, F. Kassabji, and P. Fauchais, *7th International Symposium on Plasma Chemistry,* Eindoven, Netherlands, 1985, pp. 1161. The advantages of utilizing VPS over conventional APS are lower porosity in the resulting coating caused by incomplete melting, wetting, or fusing together of deposited particles; lower oxides in the resulting coating deposit; and higher particle velocities leading to denser deposits. See, T. S. Srivatsan and E. J. Lavernia, *J. Mater. Sci.,* 27 (1992) 5965; and D. Apelian, D. Wei, and B. Farouk, *Metall. Trans.,* 20B (1989) 251.

Any thermal plasma spraying technique enclosed in a controlled atmosphere other than air or vacuum can be classified as controlled atmosphere plasma spraying (CAPS). Inert plasma (IPS) involves the plasma spraying into an inert gas (He, $N_2$) chamber. Shrouded plasma spraying is often used to produce TBCs in which the plasma jet is protected from the atmosphere. The shielding nozzle is connected to the anode of the plasma torch, and the nozzle is in close proximity (100–130 mm) to the substrate. See, L. Pawlowski, *The Science and Engineering of Thermal Spray Coatings.* John Wiley & Sons, England, 1995.

Grain Sizes of Materials

The fine grain sizes of materials described dictate that specialized characterization techniques be utilized. Grain size determination is performed using X-ray diffraction, which provides an average value, as well as transmission electron microscopy, by which size distributions are determined. These techniques are also used to provide information regarding chemical composition, solubility of second phases, etc. Grain growth in nanocrystalline materials can also be indirectly detected by the accompanying exothermic heat release. This effect is investigated using differential scanning calorimetry.

Microstructural Stability

Nanocrystalline materials possess a significant fraction of high energy, disordered grain boundary regions which provide a strong driving force for grain growth. The ability to retain ultrafine grain sizes during hot consolidation, however, is critical since it is precisely the fine grain size and large grain boundary volume which provide unique properties to the bulk material. Reviews on the subject by Suryanarayana *International Materials Reviews,* 40 (1995) 41–64; and T. R. Malow and C. C. Koch, in D. L. Bourell, (ed) *Synthesis and Processing of Nanocrystalline Powder,* The Minerals Metals and Materials Society, Warrendale, Pa., 1996, pp. 33–44 have demonstrated that a number nanocrystalline materials experience significant grain growth at room temperature, including Pd, which has a melting point of 1552° C.

Conversely, other nanocrystalline alloys have been found to exhibit an inherent grain size stability, which has been explained on the basis of narrow grain size distributions, equiaxed grain morphology, low energy grain boundary structures, relatively flat grain boundary configurations and residual porosity. In many cases, abnormal grain growth is observed, which may indicate the inhomogeneous distribution of grain growth inhibitors, such as pores or impurities. Direct evidence linking them to the proposed mechanisms is scarce.

As a general observation, Malow et al. supra, have noted that those nanocrystalline materials which have exhibited significant thermal stability tend to share one common feature; they are multicomponent, i.e. they are either alloys or they contain impurities.

As an example, significant improvements in the thermal stability of nanocrystalline Al alloys have been achieved through the in situ formation of fine Idispersoids during cryogenic high energy milling. In this work, as described in M. J. Luton, C. S. Jayanth, M. M. Disko, S. Matras, and J. Vallone, in L. E. McCandlish, et al., (eds), *Multicomponent Ultrafine Microstructures,* Materials Research Society Symposium Proceedings, Pittsburgh, Pa., 1989, pp. 79–86, Luton milled Al powder in an attritor under a liquid nitrogen slurry. Fine particles 2–10 nm in diameter spaced 50–100 nm apart formed as a result of this "cryomilling" process were found to impede grain growth at high temperature. Using electron energy loss spectroscopy (EELS), these were shown to contain equal amounts of O and N, and were henceforth identified as aluminum oxy-nitride particles. The dispersoids effectively maintained a stable 50 to 300 nm grain size in the cryomilled Al after heat treatment for 5 hours at 783 K, or 84% of the melting point of Al. In addition, the liquid nitrogen cryomilling process, has been shown to be effective in producing fine-grained, stable microstructures in Al containing alloys, including NiAl and Fe −10 wt. % Al.

The theoretical foundation for particle pinning of grain boundaries has been established for coarse grained materials. This phenomenon was first addressed by Zener who considered the minimum radius of spherical grains, R, which could be effectively pinned by a homogeneously distributed volume fraction, f, of particles of radius r. The criterion for the limiting case is ;described by the equation:

$$R=4r/3f$$

This was later expanded by Gladman in T. Gladman, *Proc. R. Soc. London, Ser. A,* 294 (1966) 298–309, to take into account the grain size inhomogeneity, Z, defined as the size of the largest grain divided by the size of the average grain. The resultant equation relates the volume fraction, f, of particles of radius r, capable of pinning grains of average radius $R_o$, with size inhomogeneity Z:

$$r=6R_of/\pi(3/2-2/Z)^{-1}$$

These equations are applied to grain growth data obtained from the nanocrystalline powders and coatings. This provides valuable insight into the applicability of conventional pinning theory in the nanocrystalline regime.

Thermally Sprayed Inconel Coatings

Three HVOF coatings of nickel based Inconel 718 are described. The first utilizes coarse grained Inconel 718 powders as the baseline while the second incorporates nanocrystalline powders produced using room temperature milling in a methanol slurry. The average grain size for the Inconel powders after milling was calculated to be 17 nm. Mechanical analysis of the resultant coatings reveals a measurable increase in hardness associated with the use of nanocrystalline powder. This is particularly evident when the coating parameters, such as temperature, are optimized for the nanocrystalline powder, as shown in Table 2.

TABLE 2

Hardness of Inconel coating produced using HVOF

| Powder Microstructure | Coating Process | Hardness (DPH) |
|---|---|---|
| Coarse-grain | Standard HVOF | 440 |
| Nanocrystalline | Standard HVOF | 530 |
| Nanocrystalline | High-temperature HVOF | 700 |

Reactive Thermal Spray—Control Coating

In this case, the coarse grained, micrometer sized powders are thermally sprayed onto a substrate using the HVOF process. The finished coating is in the range of 0.1–0.5 mm in thickness. This material is representative of the coatings produced using current technology and serve as the baseline against which any subsequent improvement can be measured.

The potential technological benefits of the approach are manifold. Many other forms of the invention are possible. For instance, instead of the HVOF thermal treatment there could be a combination of different thermal treatments. Also, the nanocrystalline material can be a combination of different materials. The products produced by procedure can have different shapes and forms, and or thickness of coating. For example, there are approximately 1500 weld overlays in a single ship. The anticipated life cycle of these welds could be significantly extended if a nanocrystalline coating with the associated improvements in hardness and wear characteristics could be used. Moreover, it has been estimated that a significant proportion of the valve stems that fail in ships are due to steam erosion. The improved wear properties of nanocrystalline coatings are ideally suited for this particular application.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

I claim:

1. A method of forming an object comprising:

forming agglomerated nanocrystalline material in a size suitable for thermal spraying, said agglomerated nanocrystalline material being formed by milling powder material to nanocrystalline size followed by continued milling, whereby the milling is further controlled such that mechanical welding and alloying of the formed nanocrystalline powder material occurs, thereby forming said agglomerated nanocrystalline material; and thermally spraying said agglomerated nanocrystalline material onto a form to form said object characterized at least in part by a nanocrystalline microscopic structure.

2. The method of claim 1 wherein forming said agglomerated nanocrystalline material comprises cryomilling said nanocrystalline powder to mechanically alloy said nanocrystalline powder to form said agglomerated nanocrystalline material.

3. The method of claim 1 wherein forming said agglomerated nanocrystalline material comprises cryomilling said nanocrystalline powder in an attritor mill to mechanically alloy said nanocrystalline powder to form said agglomerated nanocrystalline material.

4. The method of claim 1 wherein forming said agglomerated nanocrystalline material comprises mechanically alloying powder particles of alloyed materials by repeated welding and fracture events at a cryogenic temperature to mechanically alloy said nanocrystalline powder to form said agglomerated nanocrystalline material.

5. The method of claim 1 wherein thermally spraying said agglomerated nanocrystalline material to form said object comprises atmospheric plasma spraying.

6. The method of claim 1 wherein thermally spraying said agglomerated nanocrystalline material to form said object comprises arc spraying said agglomerated nanocrystalline material to form said object.

7. The method of claim 1 wherein thermally spraying said agglomerated nanocrystalline material to form said object comprises detonation gun spraying.

8. The method of claim 1 wherein thermally spraying said agglomerated nanocrystalline material to form said object comprises high velocity oxy-fuel spraying.

9. The method of claim 1 wherein thermally spraying said agglomerated nanocrystalline material to form said object comprises vacuum plasma spraying.

10. The method of claim 1 wherein thermally spraying agglomerated nanocrystalline material to form said object comprises controlled atmosphere plasma spraying.

11. The method of claim 1 wherein thermally spraying said agglomerated nanocrystalline material to form said object comprises flame spraying.

12. The method of claim 1 wherein thermally spraying said agglomerated nanocrystalline material to form said object comprises forming a coating onto a substrate.

13. The method of claim 1 wherein thermally spraying said agglomerated nanocrystalline material to form said object comprises forming a three dimensional object.

14. A method for forming a composition of matter comprising:

forming an agglomerated nanocrystalline material in a size suitable for thermal spraying, said agglomerated nanocrystalline material being formed by milling powder material to nanocrystalline size followed by continued milling, whereby the milling is further controlled such that mechanical welding and alloying of the formed nanocrystalline powder material occurs, thereby forming said agglomerated nanocrystalline material; and thermally spraying said agglomerated nanocrystalline material to form said matter which is characterized by a nanocrystalline microscopic structure.

* * * * *